US008869441B1

(12) United States Patent
Raimondi et al.

(10) Patent No.: US 8,869,441 B1
(45) Date of Patent: Oct. 28, 2014

(54) SHELF SIGN

(71) Applicants: Ralph Raimondi, Chino Valley, AZ (US); Lida Raimondi, Chino Valley, AZ (US)

(72) Inventors: Ralph Raimondi, Chino Valley, AZ (US); Lida Raimondi, Chino Valley, AZ (US)

( * ) Notice: Subject to any disclaimer, the term of this patent is extended or adjusted under 35 U.S.C. 154(b) by 0 days.

(21) Appl. No.: 14/297,783

(22) Filed: Jun. 6, 2014

Related U.S. Application Data

(60) Provisional application No. 61/832,809, filed on Jun. 8, 2013.

(51) Int. Cl.
*G09G 3/20* (2006.01)
*A47B 65/00* (2006.01)
*G09F 7/18* (2006.01)

(52) U.S. Cl.
CPC ..... *G09F 7/18* (2013.01); *G09F 2007/1843* (2013.01); *A47B 65/00* (2013.01); *G09F 2007/1856* (2013.01)
USPC ..... 40/654; 40/611.06; 40/611.09

(58) Field of Classification Search
CPC ..... A47B 65/00; G09F 3/20
USPC ..... 40/611.06, 611.09, 654; 211/42
See application file for complete search history.

(56) References Cited

U.S. PATENT DOCUMENTS

| | | | | | |
|---|---|---|---|---|---|
| 504,233 | A | * | 8/1893 | McVey et al. | 211/43 |
| 575,294 | A | * | 1/1897 | Borden | 211/184 |
| 1,376,725 | A | | 5/1921 | Ohnstrand | |
| 1,396,910 | A | * | 11/1921 | Annable | 40/642.02 |
| 1,557,419 | A | * | 10/1925 | Clarke | 211/43 |
| 1,675,269 | A | * | 6/1928 | Hine | 108/61 |
| 1,992,487 | A | * | 2/1935 | Jones | 40/725 |
| 2,070,652 | A | * | 2/1937 | Elmer | 40/651 |
| 2,895,241 | A | | 7/1959 | Ferdinand et al. | |
| 4,208,818 | A | * | 6/1980 | Butcher | 40/650 |
| 4,593,824 | A | | 6/1986 | Pfeifer | |
| D308,394 | S | * | 6/1990 | Smith | D19/34.1 |
| 4,998,985 | A | | 3/1991 | Sankey | |
| 5,275,297 | A | | 1/1994 | Dokoupil et al. | |
| 5,511,672 | A | * | 4/1996 | Young et al. | 209/546 |
| 6,263,603 | B1 | | 7/2001 | Wildrick | |
| 6,352,162 | B1 | | 3/2002 | Yang et al. | |
| 6,889,856 | B2 | * | 5/2005 | Clark et al. | 211/184 |
| 2004/0020091 | A1 | * | 2/2004 | Johnson et al. | 40/661.03 |
| 2010/0206829 | A1 | | 8/2010 | Clements et al. | |

* cited by examiner

*Primary Examiner* — Gary Hoge
(74) *Attorney, Agent, or Firm* — Kenneth L Tolar

(57) ABSTRACT

A shelf sign is designed for use with a conventional bookend that typically includes a horizontal plate for slipping beneath a book, and a U-shaped retainer vertically extending therefrom. The sign includes a planar display member having a pair of juxtaposed pockets formed therein. A first, wide pocket receives the U-shaped retainer on the bookend and a second, narrow pocket receives any one of a plurality of identification strips to describe a particular category to be displayed on a shelf. Accordingly, when a user positions the bookend next to a group of items in a conventional fashion, the identification strip is readily visible from either end of an aisle.

5 Claims, 2 Drawing Sheets

SHELF SIGN

CROSS REFERENCE TO RELATED APPLICATIONS

This application is entitled to the benefit of provisional patent application No. 61/832,809 filed on Jun. 8, 2013, the specification of which is incorporated herein by reference.

BACKGROUND OF THE INVENTION

The present invention relates to a sign that conspicuously identifies items organized on a shelf.

DESCRIPTION OF THE PRIOR ART

Many archival facilities, such as libraries and museums, stock and categorize items on shelves having aisles therebetween. Each category is usually identified by a label attached to a front edge of one or more shelves. However, because the label faces the aisle, a viewer must be directly in front of the shelf in order to read any identifying indicia. As a result, the viewer must traverse the entire length of one or more aisles in order to locate or identify a particular item of interest.

Accordingly, there is currently a need for a shelf sign that is readily visible from either end of an aisle. A review of the prior art reveals no shelf labeling devices that adequately address this problem. For example, Chinese patent no. CN203028578 discloses a bookend having a pair of hinged card holders for identifying books on a shelf. However, the hinged card holders are parallel to the shelf when the bookend is in use and, therefore, present the same visibility issues as other conventional shelf labels.

Chinese patent no. CN202060291 discloses a dual bookend with a sliding panel for supporting books.

U.S. Pat. No. 1,376,725 to Ohnstrand discloses a label holder comprising a plate attached to a front edge of a shelf having an identifying label slidably received therein.

U.S. Pat. No. 2,895,241 issued to Feminand et al. discloses a shelf molding having a sign slidably received therein.

U.S. Pat. No. 4,593,824 issued to Pfeifer discloses a tag holder for suspending merchandise from a support structure.

U.S. Pat. No. 4,998,985 issued to Sankey discloses a video cassette storage and display sleeve.

U.S. Pat. No. 5,275,297 issued to Dokoupil et al. discloses a clip-on book support and label holder.

U.S. Pat. No. 6,263,603 to Wildrick discloses a label holder for flat-faced shelving comprising a transparent front panel, a rear panel proximally spaced from the front panel and a label therebetween.

All of the shelf-labeling devices described above include identifying indicia that face an aisle, which are not viewable unless a person is standing adjacent to the pertinent shelf. The present invention overcomes the disadvantages of prior-art shelf-identification systems by providing a display member having a first pocket that receives the upstanding retainer on a conventional bookend, and a second, juxtaposed pocket that receives an identification strip. When the display member is properly attached to the bookend, the identification strip is perpendicular to the shelf, and partially extends into the aisle, where it is readily visible from either end of the shelf.

SUMMARY OF THE INVENTION

The present invention relates to a shelf sign for use with a conventional bookend that typically includes a horizontal plate for slipping beneath a book with a U-shaped retainer vertically extending therefrom. The sign according to the present invention includes a planar display member having a pair of juxtaposed pockets formed therein. A first, wide pocket receives the U-shaped retainer and a second, narrow pocket receives any one of a plurality of identification strips that each describe a particular category of items to be displayed on a shelf. Accordingly, when a user positions the bookend next to a group of items in a conventional fashion with the display member attached thereto, the identification strip is readily visible from either end of an aisle.

It is therefore an object of the present invention to provide a shelf sign that is visible from either end of an aisle.

It is another object of the present invention to provide a shelf sign that is easily securable to a conventional bookend.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
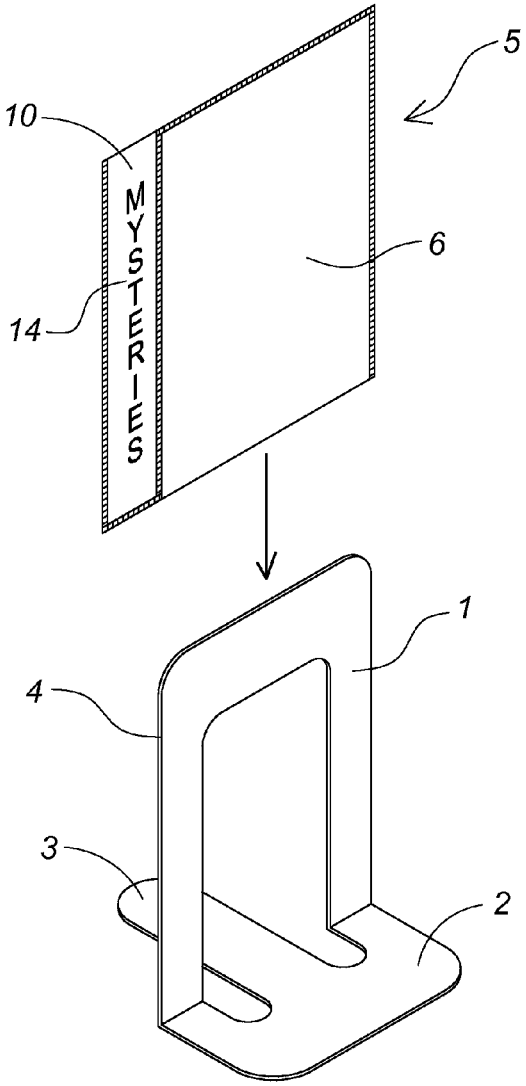
FIG. 1 is a perspective view of a conventional bookend with the sign according to the present invention being attached thereto.
Figure 3:
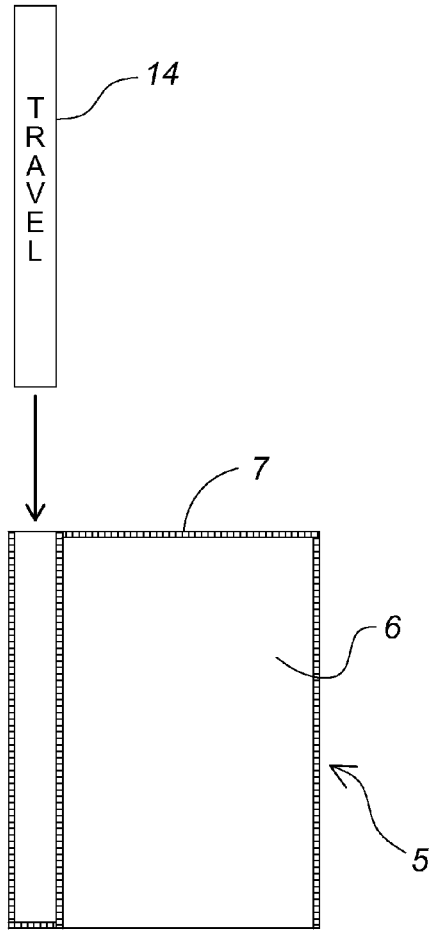
FIG. 3 is a plan view of the display member with an identification strip being inserted therein.
Figure 2:
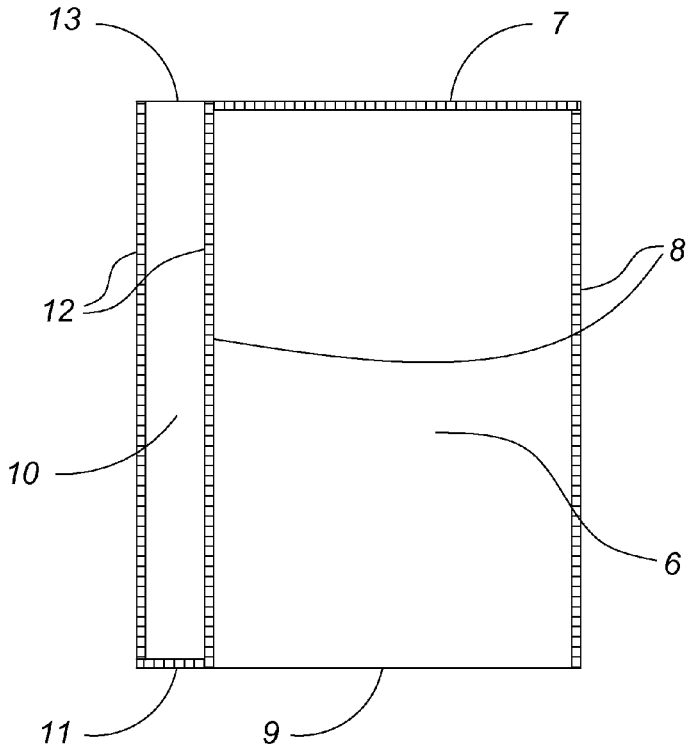
FIG. 2 plan view of the display member.
Figure 4:
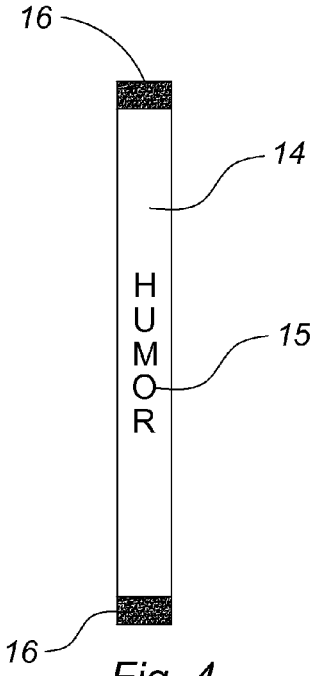
FIG. 4 is an isolated, plan view of a first embodiment of the identification strip.
Figure 5:
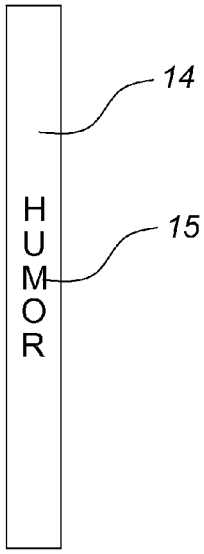
FIG. 5 is an isolated, plan view of a second embodiment of the identification strip.

The present invention relates to a shelf sign for use with a conventional bookend 1 typically having a thin, horizontal plate with a wide portion 2 on one side and a narrow portion 3 on another side. Vertically extending from the plate is a U-shaped retainer 4 for supporting upright objects on the shelf when either portion of the plate is slid beneath an outermost object.

The sign according to the present invention is designed for use with the conventional bookend of the type described above and includes a planar display member 5 having a pair of juxtaposed pockets formed therein. A first, wide pocket 6 is defined by a sealed upper edge 7, a pair of sealed side edges 8 and an open bottom edge 9 in communication with an interior chamber. The chamber is dimensioned and configured to firmly receive the U-shaped retainer 4 on the bookend.

Adjacent to one of the sealed side edges is a narrow, transparent or translucent pocket 10 that is co-planar to the first pocket 6. The narrow pocket 10 is defined by a sealed bottom edge 11, a pair of sealed side edges 12 and an open upper end 13 in communication with an interior compartment. The compartment is dimensioned and configured to receive any one of a plurality of identification strips 14 for describing a particular category of items displayed on a shelf. Each identification strip includes indicia 15, and possibly at least one color band 16, on each of two opposing faces for readily identifying the particular category or classification of displayed items.

Accordingly, a user positions the bookend adjacent to a group of items in a conventional fashion. An identification strip that properly describes the group according to category or another desired classification is placed within the narrow pocket. The wide pocket is slid over the retainer whereby the strip is perpendicular to the shelf and is readily visible from either end of the aisle.

The uniquely-designed display panel can be easily removed from a bookend and attached to a different bookend in another location. Likewise, a given identification strip can be easily removed from a designated pocket and placed within a pocket on another display member. Therefore, the sign according to the present invention is not only visible from an end of the aisle, but allows a custodian or exhibitionist, such as a librarian, who uses multiple bookends, to easily install and rearrange shelf labeling with minimal effort.

The above-described device is not limited to the exact details of construction and enumeration of parts provided herein. For example, though the device has been primarily depicted and described as being used with a conventional bookend, it can also be adapted to attach to virtually any upright item on a shelf without departing from the spirit of the present invention. Furthermore, the size, shape, materials of construction and number of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a bookend having a horizontal plate that is slid beneath an outermost item on a shelf, and a retainer vertically extending from said plate for maintaining items upright on said shelf, a sign comprising:

a planar display member having a wide first pocket receiving said retainer, and a narrow second pocket adjacent to said wide first pocket;

an identification strip received within said narrow second pocket, said identification strip having indicia thereon corresponding to a category assigned to said items upright on said shelf.

2. The combination according to claim 1 wherein said identification strip further includes a color band on at least one face for further identifying the category of items resting on the shelf.

3. The combination according to claim 1 wherein said wide first pocket is defined by a sealed upper edge, a pair of sealed side edges and an open bottom edge in communication with an interior chamber.

4. The combination according to claim 3 wherein the narrow second pocket is defined by a sealed bottom edge, a pair of sealed side edges and an open upper end in communication with an interior compartment.

5. The combination according to claim 1 wherein said narrow second pocket is transparent so that said indicia is readily visible when said identification strip is received within said narrow second pocket.

* * * * *